US006659544B2

(12) United States Patent
Hollett et al.

(10) Patent No.: US 6,659,544 B2
(45) Date of Patent: Dec. 9, 2003

(54) RECONFIGURABLE CHAIR FOR INFANT CARRIERS AND TODDLERS OR SMALL CHILDREN

(76) Inventors: Stephen M. Hollett, 4 Woodward La., Durham, NC (US) 27713; Joann I. Hollett, 4 Woodward La., Durham, NC (US) 27713

( * ) Notice: Subject to any disclaimer, the term of this patent is extended or adjusted under 35 U.S.C. 154(b) by 0 days.

(21) Appl. No.: 09/995,307

(22) Filed: Nov. 27, 2001

(65) Prior Publication Data

US 2003/0098597 A1 May 29, 2003

(51) Int. Cl.[7] ..... A47C 13/00
(52) U.S. Cl. ..... 297/130; 297/125; 297/118
(58) Field of Search ..... 297/130, 153, 297/378.1–378.12, 467, 125, 118

(56) References Cited

U.S. PATENT DOCUMENTS

| | | | | |
|---|---|---|---|---|
| 597,665 A | | 1/1898 | Andrén | |
| 1,361,505 A | * | 12/1920 | Snideman | 297/153 |
| 1,389,940 A | | 9/1921 | Erbeau | |
| 2,050,667 A | * | 8/1936 | Moreland | 297/130 |
| 2,159,517 A | | 5/1939 | Beeman | |
| 2,560,708 A | | 7/1951 | Titus | |
| 2,994,557 A | * | 8/1961 | King | 297/153 |
| 3,203,731 A | | 8/1965 | Krueger | |
| 3,246,928 A | | 4/1966 | Haynes et al. | |
| 3,649,074 A | * | 3/1972 | McDonald et al. | 297/37 |
| 4,749,232 A | | 6/1988 | Guichon | |
| 5,087,097 A | * | 2/1992 | Hehn | 297/153 |
| 5,158,337 A | | 10/1992 | Leggett | |
| 5,248,181 A | | 9/1993 | Efthimiou | |
| 5,688,024 A | | 11/1997 | Arizpe-Gilmore | |
| 6,010,184 A | | 1/2000 | Lee et al. | 297/130 |
| 6,074,007 A | | 6/2000 | Helmsderfer et al. | 297/335 |
| 6,082,814 A | | 7/2000 | Celestina-Krevh et al. | |
| 6,203,102 B1 | | 3/2001 | Helmsderfer et al. | 297/130 |
| 6,224,148 B1 | * | 5/2001 | Lee et al. | 297/105 |

OTHER PUBLICATIONS

Gaychrome, Kindercraft Marketing Publication, Publication Date Unknown, p. 1–2.

* cited by examiner

*Primary Examiner*—Peter R. Brown
*Assistant Examiner*—Stephen D'Adamo
(74) *Attorney, Agent, or Firm*—Jenkins, Wilson & Taylor, P.A.

(57) ABSTRACT

The present invention comprises a reconfigurable chair for home or restaurant use for supporting a toddler or small child in a sitting position or an infant in an infant carrier.

6 Claims, 3 Drawing Sheets

RECONFIGURABLE CHAIR FOR INFANT CARRIERS AND TODDLERS OR SMALL CHILDREN

BACKGROUND OF THE INVENTION

1. Field of the Invention

The invention relates to industrial chairs for use with children. More specifically, the present invention relates to a reconfigurable chair designed to accommodate either a toddler or small child sitting or an infant in an infant carrier for use in restaurants or at home.

2. Description of Related Art

When families go to a restaurant or other similar facility to eat out, they often take their small children and infants. For a more pleasurable dining experience for the entire family, and particularly the adult diners, toddlers and small children and infants must be properly and safely accommodated at the table.

While older and or larger children are often able to sit in regular adult chairs, some with the aid of a Conventional booster seat, the small child, toddler and infant child require special accommodations. For example, traditional high chairs have long been available for toddlers who are able to sit up on their own, but who are yet too small to sit in an adult chair, even with a booster seat. Furthermore, high chairs are particularly suitable for rambunctious toddlers for whom a certain amount of containment is required during a meal. High chairs provide some restraints, such as belts or crotch restraints, for a child placed therein, and therefore, provide peace of mind for the parents or caregivers during the meal. Additionally, the seating arrangement for a toddler is generally smaller than in an adult chair, thereby helping to maintain the child in a seated, upright position.

While conventional high chairs are most often suitable for toddlers who can sit upright by themselves, they are entirely inadequate for infants who do no yet have the motor skills to sit upright on their own. Infants are generally brought into restaurants in infant carriers, often referred to as a "pumpkin seat". Infant carriers usually include a cradle-shaped base for comfortably carrying or supporting the infant. A pivoting handle is usually attached to the base so an adult may manipulate and transport the carrier. When dining with an infant child, parents or caregivers often have to place the infant carrier and infant on the table, on a chair (if large enough), or on the floor. All of those available options for placement of the infant carrier are undesirable. Not only is the carrier exposed to the chances of falling, or food spillages, but oftentimes there is not sufficient table space for placing the carrier thereon. Furthermore, a chair may be too small to accommodate the carrier. Even if the chair is large enough, the awkward and cumbersome shape of infant carriers often requires that the chair and carrier be wedged against the table to ensure that the carrier does not fall off of the chair. This can present a precarious, and therefore, dangerous situation for the infant. Finally, placing the infant and carrier on a dirty, drafty restaurant floor is certainly an option to be avoided, even though it is often the safest of the available options.

One option, but one which is dangerous and discouraged or prohibited by many restaurants, is to turn a traditional high chair upside-down and place the infant carrier in the wide base of the chair. In doing so, the chair rests on the very narrow seat portion. Therefore, the upside-down chair is very likely to be tipped over or fall, which could injure an infant placed thereon. Furthermore, the restaurant could be exposed to legal liability for an injured child. While such an option is discouraged, parents or caregivers sometimes still choose to do so, and restaurants will allow them for the purposes of accommodation or lack of a more suitable option.

Attempts have been made to develop a support device specifically for infant carriers. Many such structures are expensive and complicated and are only adapted to a specific carrier design. If a restaurant does not have a specific device for the infant carrier, the parents or caregivers have to carry their own support device. As may be appreciated, it is very inconvenient and time-consuming to have to transport and set up such a device in a restaurant.

One type of device, for supporting a variety of styles of different infant carriers, consists of a sling stretched between two support elements. The sling forms a hammock to receive the carrier. Such a device is usually suitable for the purpose of supporting the carrier above the floor, regardless of the shape of the carrier. However, such devices must be purchased and maintained by a restaurant in addition to their other separate high chair structures. Further, these devices do not reach table height and thus do not allow the infant to be engaged in the dining experience.

Another commercially available product purports to be suitable for both infants and toddlers. Essentially, the product is a traditional high chair which can recline for cradling an infant. However, such a product requires that the infant be removed from its carrier and placed in the plastic seat of the product. For a parent or caregiver, such a scenario is not desirable. First, the plastic seat is hard and cold, and may even be dirty. Personal infant carriers usually have cushions on which the baby rests and the parents or caregivers know that their carrier is clean. Therefore, they are reluctant to switch the infant from their personal carrier to a public high chair device. Secondly, the infant may be nestled in blankets and other such covers, and may even be sleeping. Having to wake the infant and/or move all of the blankets to the public high chair device would further deter use of such a product. Finally, the parents, caregivers, or the restaurant staff are left with having to store the bulky, empty infant carrier during the meal.

Therefore, it would seem that the only practical option is to maintain a large number of dedicated infant carrier support devices in addition to high chairs for small children. A significant drawback, however, to any dedicated infant carrier, is that the restaurant must keep a substantial number of such devices on hand, and also must obtain separate high chairs for toddlers. Available infant carriers and high chairs are large and bulky, and therefore, require a substantial amount of floor space. While some high chairs and infant carriers are stackable, generally they are not.

Another drawback is the additional purchase and replacement costs for separate devices. However, restaurants, and particularly family-type restaurants, desire to keep their family patrons not only satisfied, but also comfortable with the thought that their children will be safe during the dining experience. Therefore, they maintain a large number of different devices to do so.

Another drawback to having a large number of dedicated support devices is the cleaning required for such structures. Food is usually splattered all over by toddlers and may also be splattered by older infants. Of course, parents and caregivers do not want to place their child in a high chair or other device which is still dirty from the previous child. Therefore, the workloads of waitpersons, buspersons, and hosts are all increased to ensure clean high chairs and infant carrier support devices are always available.

Some attempts have been made to provide a seat adapted to accommodate both small children and infants in an infant carrier. So, for example, in U.S. Pat. No. 6,010,184 to Lee et al. a reconfigurable high chair provides a movable sliding seat designed for small children and cross bars that support an infant carrier when the seat is slid out of the way. A problem with this design, however, is that the movable seat involves several posts that move and that are subject to breakage over time thus endangering the child. In addition, the shape of the frame and chair allows several points, where an appendage or piece of clothing can get caught as the chair is moved from an up position to a down position.

Another problem is the support mechanism for the high chair is a fixed width and will only accommodate a single width seat.

It is therefore an object of this invention to provide toddler and infant carriers which are free of the inherent danger and complexity of prior chairs.

It is also an object of this invention to provide a toddler and infant carrier available to restaurant owners which is safe and secure. It also therefore reduces the liability exposure of the restaurant.

SUMMARY OF THE INVENTION

The present invention comprises a reconfigurable chair which affords an infant carrier configuration and a toddler or small child configuration and which can readily be converted from one mode to the other by folding up or down the back seat of the toddler or small child chair portion. Specifically, the reconfigurable chair comprises a frame providing a base for placement on a floor surface having a front side, back side, and two opposing sides. The reconfigurable chair also comprises a seat assembly supported on the frame at a position elevated above the base and having a bottom seat fixedly secured to the frame and a movable back rest pivotally joined to the bottom seat. The movable back rest is operable between an upright seat position in which the toddler or small child can sit on the bottom seat and have its back against the back rest and a closed position in which the back rest is folded down on the bottom seat. The chair also has a front cross member on the front side of the chair extending between the opposite left and right sides of the frame and positioned on the frame above the bottom seat and a back cross member in the back side of the frame extending between the left and right side of the frame positioned on the frame between the levels of the back cross member and the bottom seat and wherein the front and back cross members are positioned relative to one another and adapted to receive an infant carrier facing toward the back of the frame when the movable seat back rest is folded down.

The frame can optionally further comprise a seat belt for strapping in a toddler or small child in the seated position or strap the infant carrier in place and further a crotch strap can be installed to prevent a toddler or small child from slipping under the seat belt and falling out of the reconfigurable chair.

In general, the base of the invention reconfigurable chair is larger than the support area for stabilizing the frame on the floor during use. Horizontal, diagonal or the like cross members can further be added for stability. Other elements can also be added to the frame such as shelves, hangers, drink holders and the like as is fit for the particular user.

DETAILED DESCRIPTION OF SPECIFIC EMBODIMENTS

Figure 1:
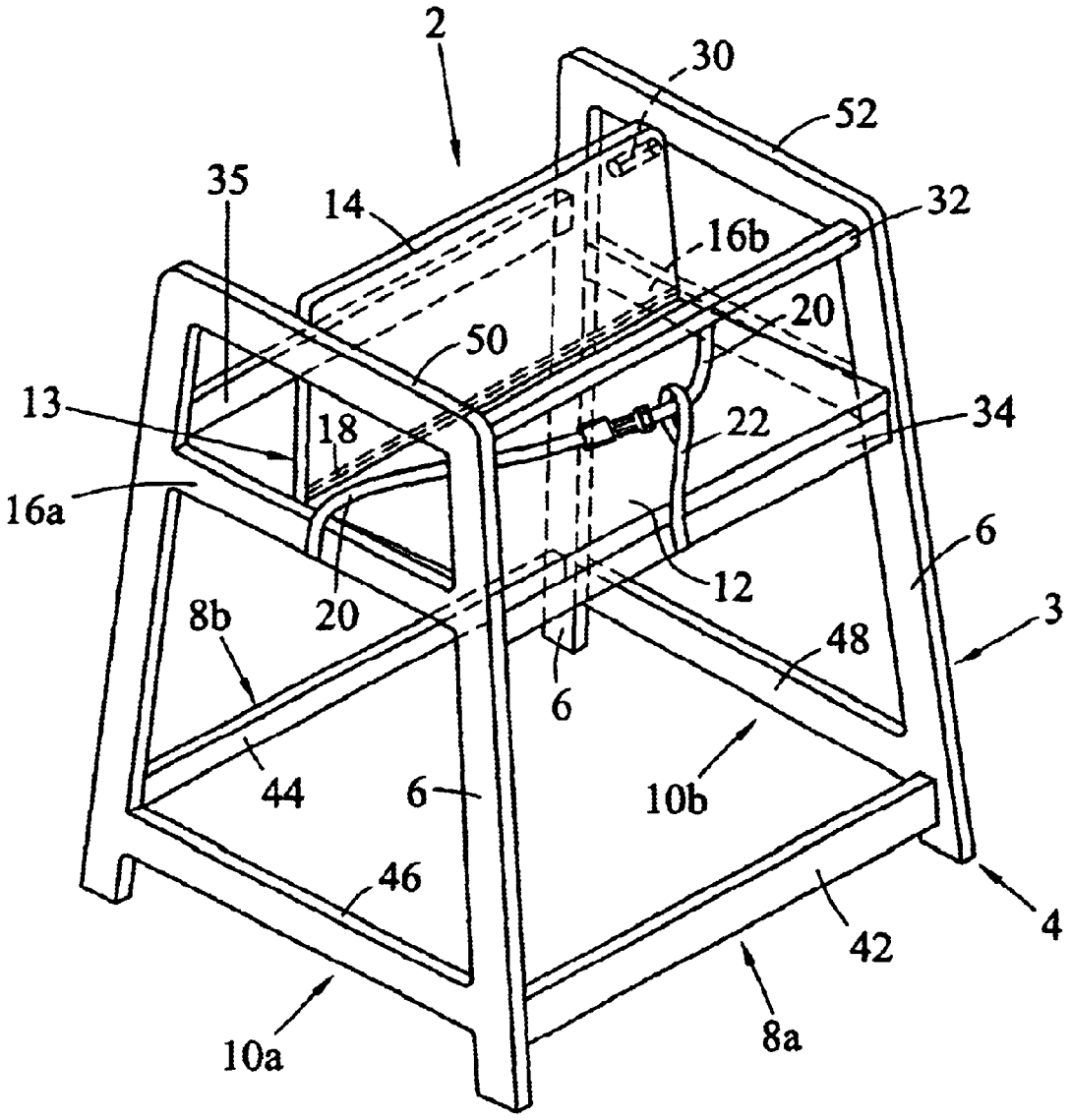
FIG. 1 is a perspective view of an embodiment of the reconfigurable chair for infant carriers and toddler or a small child.

FIG. 1 shows a perspective view of an embodiment of the reconfigurable chair of the present invention and being configured for a toddler or small child to sit in reconfigurable chair 2.

In this embodiment, reconfigurable chair 2 consists of frame 3, a base 4 and vertical support members 6. Frame 3 is preferably formed of wood or other lightweight material such as plastic. Just above base 4 are front side 8*a* and back side 8*b*, cross members 42, 44 on the front side and back side respectively and also 10*a*, 10*b* on opposing left side and right side are cross members 46 and 48 respectively of frame 3 which in this embodiment, defines a rectangular shape to base 4 which is a larger rectangle than the top of frame 3 with cross members 50, 52. This structure then provides frame 3 which is substantially supported on base 4 on a floor surface to which reconfigurable chair 2 is designed to be used.

Seat assembly 13 consists of bottom seat 12 and movable backrest 14. Movable back rest 14 is attached to bottom seat 12 via piano hinge 18 which allows back rest 14 to be moved from its upright position as pictured in FIGS. 1, 3 and 4 for accommodating a toddler or small child to a closed position (depicted in FIGS. 4 and 5) where back rest 14 is folded using piano hinge 18 to rest on bottom seat 12. Safety is provided via safety belt 20 which straps a small child in place or an infant carrier in place and crotch strap 22 which separates the legs of a toddler or small child and prevents the child from sliding out the front of reconfigurable chair 2.

A front cross member 32 extends horizontally between the top of front left vertical support 6 and the top front right support 6 toward the top of frame above bottom seat 12. Front cross member 32 adds stability to the frame, becomes part of the safety device for preventing a toddler or small child from falling out of the front of reconfigurable chair 2. In addition, as can be seen in FIG. 5, front cross member 32 used to support an infant carrier 60.

Seat assembly 13 is fixedly secured to frame 3 via attachment to a front cross bar 34 underneath the bottom seat 12 at approximately the same height as left upper 16*a* and right upper 16*b* cross members. Rear cross bar 35 in this configuration adds stability to frame 3. Further, releasable latch 30 (see FIG. 1) allows seat back 14 to be fixed in place and immovable when used by a toddler or small child for seating.

Figure 5:
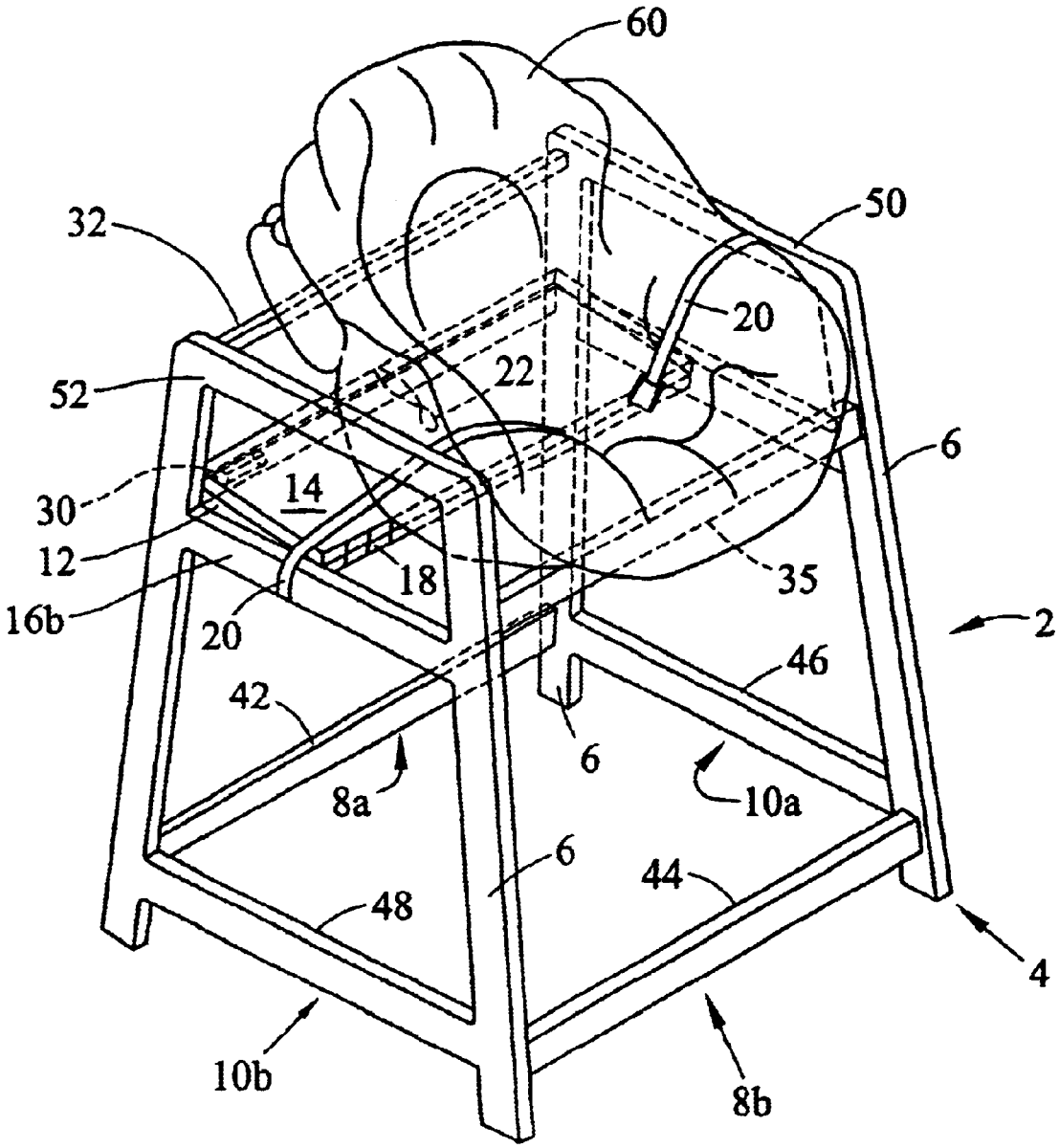
FIG. 5 is a perspective view of an embodiment of the invention configured for and showing an infant carrier positioned on the present invention chair.

FIG. 5 is a perspective view of the same embodiment shown in FIG. 1, of reconfigurable chair 2, however, it depicts a configuration for supporting an infant carrier 60. In this embodiment, frame 3 is facing the opposite direction as in FIG. 1. Infant carrier 60 faces the back side of frame 3. Seating assembly 13 has movable backrest 14 folded down onto bottom seat 12. In this configuration, infant carrier 60 can be placed between front cross member 32 and rear cross bar 35.

Figure 2:
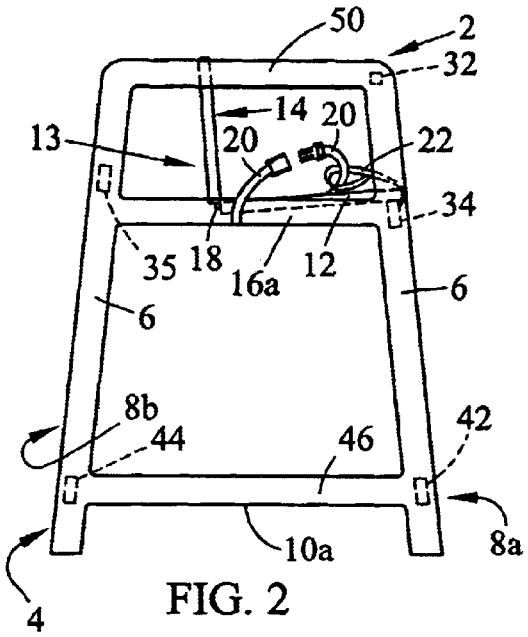
FIG. 2 is a side elevation view of the invention chair configured for a toddler or small child and showing how the back rest folds to convert to hold an infant carrier.
Figure 4:
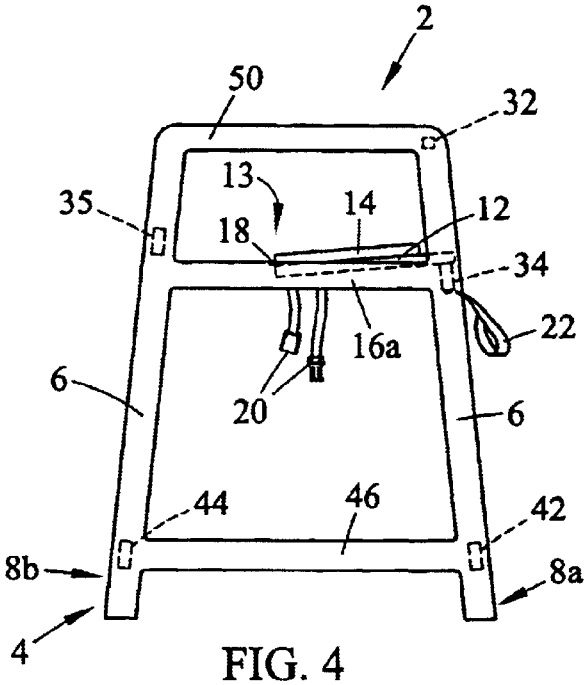
FIG. 4 is a side elevation view of the invention reconfigurable chair for infant carriers and toddler or a small child with the chair up for an infant carrier.

FIG. 2 is a side elevation of reconfigurable chair 2 configured as in FIG. 1 indicating how the movable back rest 14 moves from open position (depicted) to closed position (shown in FIG. 4).

Figure 3:
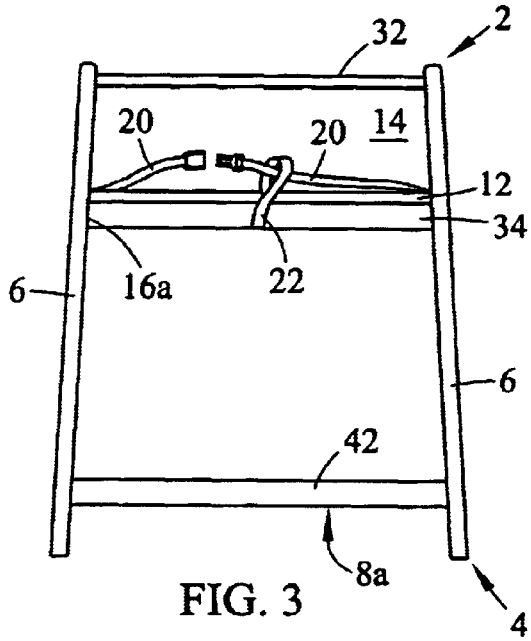
FIG. 3 is a front elevation view of the present invention reconfigurable chair set up for a toddler or small child.

In FIG. 3, a front elevation view of reconfigurable chair 2 is configured as in FIG. 1, prominent is the optional fixed crotch strap 22 and seat belt 20 visible on the front (see FIG. 1 also).

FIG. 4 is a side elevation view of reconfigurable chair 2 configured to accept infant carrier 60 as in FIG. 5. Seat assembly 13 is configured with movable back rest 14 folded down to meet fixed seat 12 and to provide clearance for infant carrier 60. Infant carrier 60, placed on reconfigurable chair 2, would face toward the rear away from the front.

While the present invention has been illustrated by the specific embodiments, figures and general description set forth above in detail, it is not the intention of the applicant to restrict or any way limit the scope of the present invention. Additional embodiments will be apparent to those skilled in the art. Accordingly, various modifications and variations may be made from such details without departure from the spirit or scope of the concepts described herein.

What is claimed is:

1. A reconfigurable chair for supporting a toddler or small child in a sitting position or an infant in an infant carrier comprising:

(a) a frame providing a base for placement on a floor surface and having a front side, a back side and two opposing sides;

(b)a seat assembly supported on said frame at an elevated position above said base, said assembly having a bottom seat fixedly secured to said frame and a movable back rest pivotally joined to said bottom seat at a first location on said bottom seat that is spaced generally near the midpoint between the front and back sides of said frame, said movable back rest being operable between an upright seating position in which said toddler or small child can sit on said bottom seat and have its back rest against said back rest and a closed position in which said back rest is folded down to a location substantially parallel to said bottom seat;

(c) a front cross member on the front side of and extending between said opposing sides of said frame and positioned on said frame at a level above said bottom seat;

(d) a back cross member on the back side of and extending between said opposing sides of said frame and positioned on said frame at a level between the levels of said front cross member and said bottom seat; and (e) said front and back cross members being further positioned and adapted for receiving an infant in an infant carrier facing towards said back side of said frame when said back rest is in said closed position.

2. A reconfigurable chair as claimed in claim 1 wherein said frame comprises a substantially vertical post at each of four corners of said frame, a first set of cross members secured to said posts and located proximate the base of said frame, a second set of cross members secured to said posts and located below said seat assembly and a third set of cross members secured to said posts and located at upper ends of said posts.

3. A reconfigurable chair as claimed in claim 2 including releasable latch means coupled to said moveable back rest for enabling said back rest to be releasably locked in the seating position.

4. A reconfigurable chair according to claim 1 which further comprises a seat belt coupled to said frame and extending across said bottom seat for restraining a toddler or small child or an infant carrier.

5. A reconfigurable chair according to claim 4 which further comprises a crotch belt coupled to said frame and being adapted to receive said seat belt.

6. A reconfigurable chair according to claim 1 wherein said base is larger than the top of said frame.

* * * * *